US005651871A

United States Patent [19]

Fromson et al.

[11] Patent Number: 5,651,871

[45] Date of Patent: Jul. 29, 1997

[54] PROCESS FOR GRAINING AND ANODIZING A METAL PLATE

[75] Inventors: Howard A. Fromson, 49 Main St., Stonington, Conn. 06378; William J. Rozell, Vernon; Robert F. Gracia, Woodstock Valley, both of Conn.

[73] Assignee: Howard A. Fromson, Stonington, Conn.

[21] Appl. No.: 534,830

[22] Filed: Sep. 27, 1995

Related U.S. Application Data

[63] Continuation-in-part of Ser. No. 372,656, Jan. 13, 1995, abandoned.

[51] Int. Cl.[6] ..... B41N 1/08; C25D 11/16

[52] U.S. Cl. ..... 205/50; 101/459; 205/139; 205/153; 205/206; 205/213; 205/219; 205/921; 428/472.2

[58] Field of Search ..... 205/50, 139, 153, 205/175, 206, 921, 213, 219; 101/459; 428/472.2

[56] References Cited

U.S. PATENT DOCUMENTS 4,183,788 1/1980 Fromson et al. ..... 430/278

4,561,944 12/1985 Sasaki et al. ..... 204/33

4,566,952 1/1986 Sprintschnik et al. ..... 204/27

*Primary Examiner*—Kathryn Gorgos

*Assistant Examiner*—William T. Leader

*Attorney, Agent, or Firm*—Chilton, Alix & Van Kirk

[57] ABSTRACT

Smooth planar metal surfaces, usually an aluminum web, intended for a lithographic printing plate, are roughened by brush graining with fine abrasive particles which are hard and dense and have a radial or disk-like configuration such that the abrasive particles are forged into the surface of the metal forming cavities in which the abrasive particles remain embedded. The embedded abrasive particles are dislodged and removed from the cavities by subjecting the web to an anodic treatment employing electrolyte materials and concentrations, temperatures and voltage which will dislodge and remove the particles while retaining the surface texture or morphology of the as-roughened surface. The web is then subjected to a second anodic treatment under conditions which favor oxide formation in order to provide a final anodized product.

8 Claims, 2 Drawing Sheets

PROCESS FOR GRAINING AND ANODIZING A METAL PLATE

This application is a continuation-in-part of application Ser. No. 08/372,656 filed on Jan. 13, 1995, now abandoned.

BACKGROUND OF THE INVENTION

This invention relates to the roughening or graining and anodizing of smooth planar metal surfaces and especially to the preparation of a grained anodized aluminum base for lithographic printing plates.

The art of lithographic printing depends upon the immiscibility of greasy substances (ink) and water and upon the preferential retention of the greasy ink by an image area on the plate and of an aqueous dampening fluid by the non-image area. Upon application of ink to the plate, the image portion retains the ink whereas the moistened non-image area repels the ink. The lithographic printing plate has a coating of a light-sensitive substance that is adherent to the anodized aluminum base sheet.

In coating an aluminum base plate with a light-sensitive material, it is desirable to provide an adherent, hydrophilic, abrasion-resistant surface. This is best achieved by graining or roughening the surface to provide a large surface area, anodizing to provide a hard surface resistant to abrasion and corrosion, and subsequently treating with a material selected to enhance the adhesion of the coating to the base layer, improve hydrophilicity and/or improve developability of the plate. Graining can be carried out by mechanically treating the aluminum, for example by brush graining or ball graining, or it can be grained chemically or electrochemically. Although electrochemical graining produces a very desirable grained surface, slurry brush graining produces a satisfactory grained surface at a significantly lower cost.

Slurry brush graining is normally carried out continuously on a moving aluminum web using a plurality of rotating brushes with an aqueous slurry of abrasive particles fed from recirculating sumps. The abrasive particles may, for example, be quartz, silica, pumice or unfused crystalline alumina.

The post anodic treatment can be done by various methods. U.S. Pat. No. 3,181,461 discloses the use of an aqueous sodium silicate. A treatment with polyvinyl phosphonic acid is disclosed in U.S. Pat. No. 3,276,868. The present invention may be utilized with these or any of the post treatment methods normally employed in conjunction with a typical anodizing process.

SUMMARY OF THE INVENTION

The present invention relates to a process for roughening smooth planar metal surfaces, usually aluminum plates or webs, by brush graining the surface with small abrasive particles which are radial or disk-like in configuration and which are capable of being forged into the surface of the metal by the brush graining operation to form a desired relatively uniform pattern of unconnected, discrete, small cavities. Usually, the abrasive particles remain embedded in the cavities. Abrasive particles which have the required configuration and are suitable for this purpose are hard and dense and include alumina and Novacite. The next step in the invention is to subject the grained metal with the residual embedded particles to an anodic treatment using an electrolyte concentration, temperature and voltage which will remove the residual embedded particles. The surfaces produced are extremely uniform and retain the surface texture or morphology of the as-roughened surfaces without the loss of morphology that is associated with other treatment processes such as alkaline etching.

It is speculated that during the treatment as described in the present invention, there is oxide formation at the interface between the metal surface of the pore and the residual embedded abrasive particles. The nature of the oxide makes this layer ultimately less dense than the base metal and to increase in volume. This will tend to push or dislodge the residual abrasive particles out of the cavities in which they are entrapped. The net result is that the particles are more efficiently removed without any excessive loss of surface morphology. Further, the present invention far more effectively removes the residual embedded abrasive particles as compared to treatment in hot solution without the use of the anodic electrolytic treatment. The process conditions also may form very fine micro-pits superimposed in and on the grained surface. After the particles have been removed, a further anodic treatment is employed to form a desired anodized product with an oxide coating.

DESCRIPTION OF THE PREFERRED EMBODIMENTS

Figure 1:
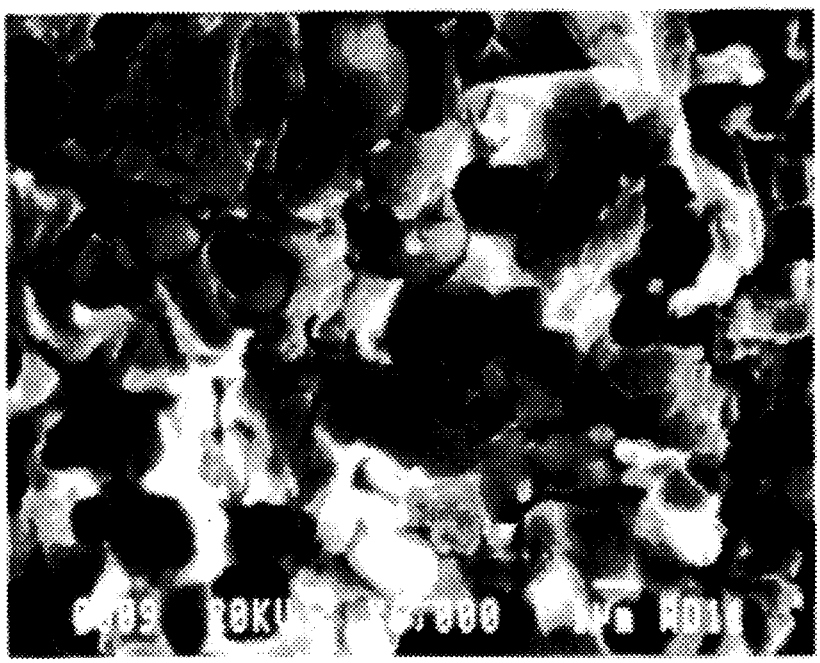
FIG. 1 is a photomicrograph at 6000× magnification of a brush grained aluminum plate which has been anodized under conventional conditions.

The brush graining of aluminum or other metal plates or webs is a well known practice. See for example U.S. Pat. Nos. 3,891,516 and 4,183,788. A properly grained plate increases the coating adhesion and also holds more water in the non-image areas. Conventional brush graining can be carried out with a variety of abrasive material such an quartz, silica, pumice or alumina in either the fused or unfused state and normally with a particle size of 1 to 20 micrometers. However, the present invention is limited to brush graining with abrasive particles which are hard and dense, which are radial in configuration (disk- or tablet-like). The particles preferably have a primary particle size of 7 microns or less. Such particles are capable of being forced or forged into the metal surface by the brush graining operation to form pits in the surface of a desirable size. This is controlled by the known technique of adjusting the web tension and the resulting force of the brushes forcing the particles against the web so that there is sufficient force to cause the particles to be forged into the web. Examples of particles suitable for the brush graining of the present invention include unfused alumina and novaculite, such as the product sold under the tradename Novacite by the Malvern Mineral Company. This latter material is a siliceous sedimentary rock that is dense, hard and even-textured. Softer abrasives such as pumice will not work. FIG. 1 of the drawings is a photomicrograph of an aluminum web which has been brush grained using a slurry of calcined unfused alumina particles and then anodized according to conventional practice. The cells of the anodizing system were held at a temperature of about 38° C. (100° F.) and the electrolyte was sulfuric acid at a concentration of 250 grams/liter. This produces a current of about 538 amps per sq. meter of web.

FIG. 1 clearly illustrates abrasive particles which were employed in the brush graining still embedded in the aluminum web even after such conventional anodizing. One such particle is identified by the arrow in this FIG. 1. The object of the present invention is to remove these embedded particles without reducing the as-grained morphology and then to form the desired anodic oxide coating.

Conventional anodizing is carried out for the purpose of forming an oxide coating and is normally held at temperatures in the range of 21° C. (70° F.) to 54° C. (130° F.) and with electrolyte concentrations and voltages which will most effectively form such a coating. Higher temperatures than these have been employed on occasion but still with the objective of forming the oxide coating and with electrolyte concentrations and voltages which favor the net formation of the oxide. A more severe combination of conditions (higher temperature, and more concentrated electrolyte) would not be employed for conventional anodizing to form an oxide coating since that would have the effect of dissolving or otherwise reducing the oxide film as it is formed. However, in accordance with the present invention, anodizing conditions outside those conventional ranges are used which results in the dislodging of the embedded abrasive particles without the loss of the basic surface roughness or morphology. A consequence of the anodizing conditions of the present invention which are used to dislodge the embedded particles is that there is little net formation of an oxide coating. This first anodizing step is then followed by a second conventional anodizing step to form the desired oxide coating, Reference is made to U.S. Pat. No. Re. 29,754 and to U.S. Pat. Nos. 3,920,525, 4,131,518 and 4,865,699 purely as examples of anodizing process schemes which could be employed in the present invention, However, it is to be noted that the present invention is not limited to those specific examples or to a continuous process.

In accordance with the present invention, the electrolyte which is used in the first anodizing cell to dislodge the particles is either sulfuric or phosphoric acid or a mixture of these two acids at a concentration of 100 to 500 grams per liter. Nitric or hydrochloric acid cannot be used since they have an adverse effect on the morphology of the plate. Also, the temperature of the cell is maintained at a higher than normal level, 66° to 100° C. (150° to 212° F.). Furthermore, the combination of the temperature and concentration are selected from within these ranges such that the resultant voltage is less than 35 volts, It is noted that increasing the temperature and increasing the concentrations of electrolyte both increase the conductivity. With the higher conductivity electrolyte, the amperages required for the dislodging of the abrasive result in a voltage of less than 35 volts. Higher amperages, at which voltages greater than 35 volts are obtained, are not suitable. These conditions have an undesirable adverse impact on the morphology and lead to difficulties with overheating and burning of the metal web. The specific range for the current density and specifically the upper limit will depend upon the particular situation including factors such as the thickness of the web, the particular alloy of the web and, to some extent, the cooling capacity of the cell. The preferred ranges for this first cell are 200 to 400 grams per liter of acid electrolyte and 71° to 93° C. (160° to 200° F.).

As a consequence of the conditions that are maintained in this cell, little net oxide coating is formed. Although it is theorized that there is oxide formation at the interface between the particles and the metal surface which forces the particles out of the cavities, the conditions are such that the rate of dissolution of the oxide is very high relative to the rate of formation of the oxide, so that there is little net oxide remaining after treatment in this cell. On the other hand, the conditions in the specified ranges are not so severe that the morphology of the plate or web is effected.

Although some prior processes have employed graining operations which might include brush graining and have employed a subsequent anodizing operation which might include one or more cell conditions which fall within the ranges of the present invention, none are known to be for the same purpose as the first anodizing cell of the present invention and therefore none have used the required combination of conditions of temperature, concentration and voltage. For example, U.S. Pat. No. 4,566,952 discloses a two stage process for anodizing aluminum plates in which the first anodizing cell is maintained within the range of 60 to 180 grams per liter of electrolyte and 47° to 70° C. (116° to 158° F.) which both overlap with the ranges of the present invention. However, the patent further requires that the voltage be 36 to 80 volts. If a high temperature and high concentration are simultaneously selected, the resultant voltage in the cell would be below the stated limit of 36 volts. For example, at a concentration of phosphoric acid of 180 grams per liter and 70° C., the voltage of the cell is typically approximately 20 volts. The current densities required to achieve an operating voltage of 36 volts under these conditions would be excessive causing significant loss of surface morphology and burning of the aluminum. The aim of the process of U.S. Pat. No. 4,566,952 is to lay down an oxide coating in both stages or cells and to achieve a small or minimal redissolution of the oxide. That is just the opposite of the first cell of the present invention.

Figure 2:
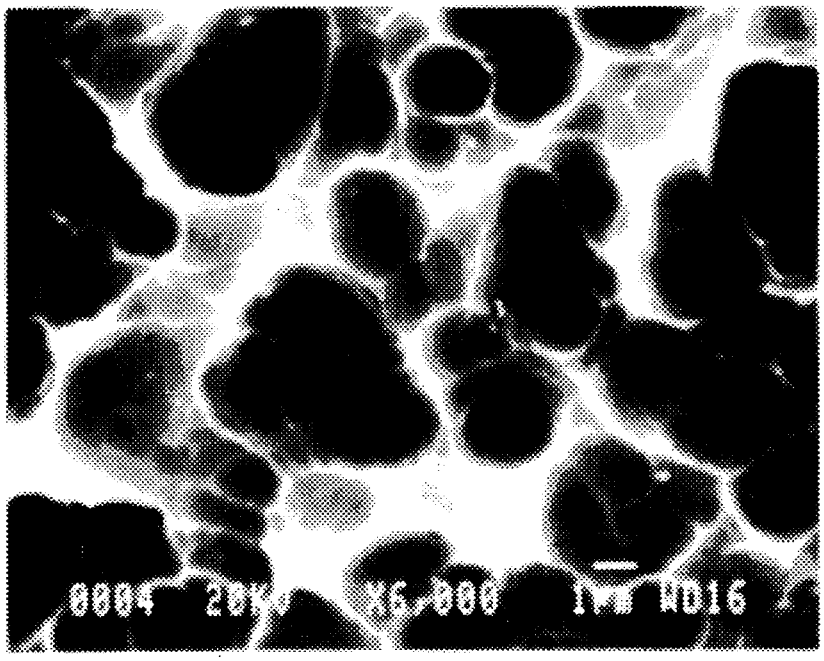
FIG. 2 is a photomicrograph at 6000× magnification of a brush grained aluminum plate which has been anodized in a single cell under the conditions of the present invention.
Figure 3:
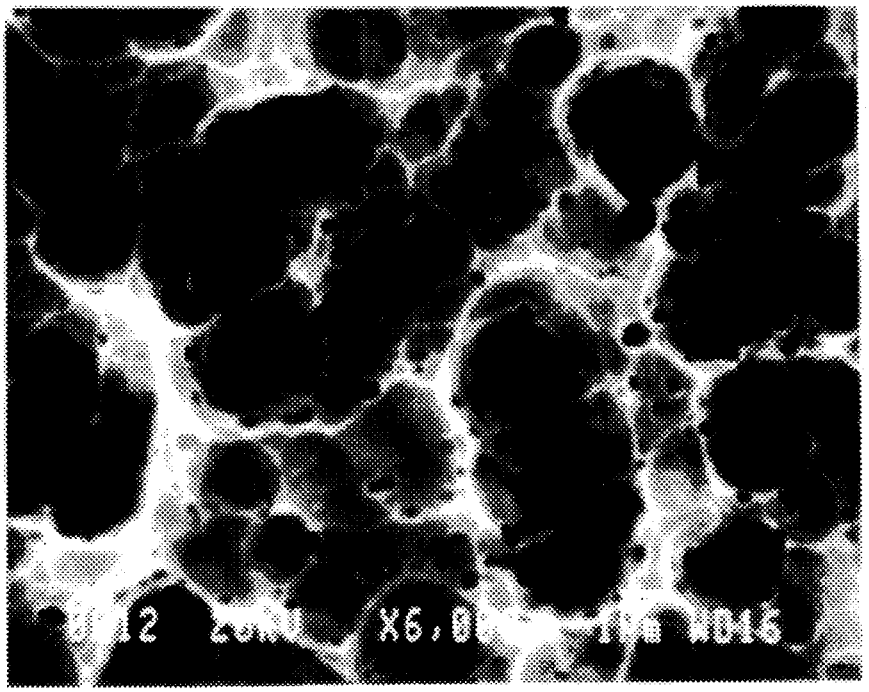
FIG. 3 is a photomicrograph at 6000× magnification of a brush grained aluminum plate which has been anodized in a series of anodizing and cathodic contact cells with the first cells being at the conditions of the present invention.

The ranges of temperature, concentration and voltage in the first cell of the present invention provide for maximum removal of particles without effecting the morphology of the grained plate. The formation and dissolution of the oxide is sufficient to pop the particles but not to take away the grained texture. FIG. 2 is a photomicrograph of an aluminum plate which has been brush grained and anodically treated according to the present invention. All of the significant embedded abrasive particles that had been present have disappeared without loss of surface roughness. FIG. 3 is a photomicrograph of a plate which has been subjected to the present invention and exhibits an additional benefit of the invention. FIG. 3 clearly shows the presence of new secondary micro pitting with these micro pits measuring about 0.1 to 0.2 micrometers. Within the range of processing conditions according to the present invention, it is possible to select conditions where this micro pitting occurs in addition to the removal of the residual embedded abrasive.

The substrate prepared according to the process of the present invention would be subsequently post treated according to any of the various methods used by those skilled in the art to prepare an anodized aluminum substrate as a support for a lithographic printing plate.

We claim:

1. A process for increasing the surface area of a planar aluminum surface and anodizing said surface comprising the steps of:

a. subjecting said planar aluminum surface to a brush graining operation employing abrasive particles having a radial configuration and a density and hardness whereby said abrasive particles are forged into the planar aluminum surface by said brush graining thereby forming cavities in said planar aluminum surface in which said abrasive particles are embedded;

b. subjecting said brush grained aluminum surface having cavities thereon with said embedded abrasive particles to a first anodic electrochemical process in an electrolyte comprising $H_2SO_4$ or $H_3PO_4$ or mixtures thereof at a concentration of 100 to 500 grams per liter, at a temperature of 66° to 100° C. and at a voltage of less than 35 volts, whereby said embedded abrasive particles are removed from said cavities without altering the basic morphology of the brush grained aluminum surface;

c. subjecting said brush grained aluminum surface with said particles removed from said cavities to a second anodic process under conditions to form an anodic oxide coating thereon.

2. A process as recited in claim 1 wherein said abrasive particles are selected from the group consisting of alumina and novaculite.

3. A process as recited in claim 2 wherein said abrasive particles are unfused calcined alumina.

4. A process as recited in claim 1 wherein said abrasive particles have a primary particle size of 7 microns or less.

5. A process as recited in claim 1 wherein said electrolyte concentration and temperature in said first anodic electrochemical process are 200 to 400 grams per liter and 71° to 93° C.

6. An aluminum planar support for a lithographic printing plate as prepared according to claims 1, 2, 3, 4 or 5.

7. A process for making an aluminum planar support for a lithographic printing plate comprising the steps of:

a. brush graining an aluminum web with an aqueous slurry of fine abrasive particles having a radial configuration and a density and hardness whereby said abrasive particles form a grained surface on said aluminum web and are forged into said surface thereby forming cavities in which said abrasive particles are embedded;

b. subjecting said brush grained aluminum web with said embedded abrasive particles to a continuous anodizing process comprising:

i. passing said web through a first anodizing cell having therein a cathode connected to a first source of electrical current, said first anodizing cell containing an electrolyte comprising $H_2SO_4$ or $H_3PO_4$ or mixtures thereof at a concentration of 100 to 500 grams per liter and at a temperature in excess of 66° C. whereby said embedded abrasive particles are removed from said cavities without altering the basic morphology of the brush grained aluminum surface;

ii. passing said web into a second anodizing cell having a cathode therein connected to a second source of electrical current, said second anodizing cell being under conditions to form an anodic oxide coating; and iii. introducing anodizing electrical currents from said first and second sources of electrical current into said web thereby dislodging said embedded abrasive particles primarily in said first anodizing cell and forming an oxide coating on said web primarily in said second anodizing cell.

8. An aluminum planar support for a lithographic printing plate as prepared according to claim 7.

* * * * *